United States Patent [19]

Mitsumi

[11] Patent Number: 4,635,520

[45] Date of Patent: Jan. 13, 1987

[54] TONE WAVESHAPE FORMING DEVICE

[75] Inventor: Katoh Mitsumi, Hamamatsu, Japan

[73] Assignee: Nippon Gakki Seizo Kabushiki Kaisha, Hamamatsu, Japan

[21] Appl. No.: 634,626

[22] Filed: Jul. 26, 1984

[30] Foreign Application Priority Data

Jul. 28, 1983 [JP] Japan ..... 58-136888

[51] Int. Cl.[4] ..... G10H 1/02; G10H 1/00

[52] U.S. Cl. ..... 84/1.26; 84/1.01

[58] Field of Search ..... 84/1.26, 1.01, 1.13, 84/1.24, 1.19

[56] References Cited

U.S. PATENT DOCUMENTS

| | | | |
|---|---|---|---|
| 4,036,096 | 7/1977 | Tomisawa | 84/1.01 |
| 4,348,929 | 9/1982 | Gallitzendörfer | 84/1.01 |
| 4,383,462 | 5/1983 | Nagai et al. | 84/1.26 |
| 4,520,708 | 6/1985 | Wachi | 84/1.01 |
| 4,536,853 | 8/1985 | Kawamoto et al. | 84/1.01 |

*Primary Examiner*—William M. Shoop, Jr.
*Assistant Examiner*—Sharon D. Logan
*Attorney, Agent, or Firm*—Spensley Horn Jubas & Lubitz

[57] ABSTRACT

Two waveshapes corresponding to an attack portion and a part of portion succeeding the attack portion of a tone to be produced are stored in a waveshape memory. The waveshape of the attack portion is read out once and thereafter the other waveshape is repetitively read out. In order to connect smoothly the repetitively read out waveshape, an interpolation operation is performed in specified sections at the end and at the beginning of the waveshape. A tone waveshape to be finally formed is constituted by the other waveshape itself in other section than the specified sections and by a new waveshape formed by the interpolation operation in the specified sections in the other waveshape, thereby realizing the smooth connection of the repetitive read out waveshapes.

18 Claims, 12 Drawing Figures

TONE WAVESHAPE FORMING DEVICE

BACKGROUND OF THE INVENTION

This invention relates to a tone waveshape forming device used in an electronic musical instrument or the like device and, more particularly, to a device capable of smoothing the connection of a repetitive portion of the waveshape in forming a tone waveshape by repeatedly reading out the waveshape of plural periods stored in a memory.

U.S. Pat. No. 4,383,462 discloses an electronic musical instrument which aims at producing a tone of a high quality by prestoring a complete waveshape of a tone signal from rising to termination of sounding of the tone in a memory and reading out the waveshape therefrom. In the waveshape memory WM31 in FIG. 3 of this United States patent, a complete waveshape is stored and this complete waveshape is read out in response to a signal KD which represents a key depression timing. Such system in which the complete waveshape is stored is disadvantageous in that it requires a large memory capacity resulting in a high manufacturing cost and besides generation of a sustained tone is practically impossible.

In order to improve this point, it has been conceived to store a part of a waveshape of plural periods out of the complete sounding period in a waveshape memory and obtain a tone signal by repeatedly reading out the partial waveshape. In the above U.S. Pat. No. 4,383,462, an example of such improvement is shown in FIG. 6. A complete waveshape in the attack period is stored in the waveshape memory WM61 and at least one fundamental period of a tone waveshape is stored in the waveshape memory WM62. An attack waveshape is read out from the memory WM61 in response to the key depression (KD signal) and the tone waveshape of the fundamental period is repeatedly read out from the memory WM62 after completion of the readout of the attack waveshape (IMF signal) until the end of tone generation (DF signal). If, however, the waveshape portion of plural periods which are repeatedly read out were simply connected, the connection between the repetitive portions would be discontinuous and a clicking noise would result. For smoothing the connection between the repetitive portions, it has been attempted to take a waveshape portion as a repetitive portion out of an original waveshape, and the waveshape portion corresponds to a site where the first amplitude value and the last amplitude value of the repetitive portion are about the same. This can connect the repetitive portions at the same amplitude but there is no continuity in the amplitude before and after the connecting point with the result that the waveshape is bent at the connecting portion of the repetitive portions which is quite unnatural. Besides, this method involves a troublesome operation for taking the waveshape portion for the repeating purpose out of a proper site of the original waveshape.

A waveshape memory is commonly constructed by using as its memory element an integrated circuit memory having a specific memory capacity. In this memory, a waveshape should preferably be stored over the entire memory area of the memory for utilizing the memory area without waste. In that case, reading of a specific waveshape of plural periods is performed by returning a read address to a predetermined repeat address when the read address has reached last address of the memory area of the waveshape. In this case also, for smoothing the connection between the repetitive waveshapes, an address having nearly the same amplitude and phase of the last address is sought out and selected as the repeat address. This method, however, has the problem that the waveshape at the connecting portion is bent and therefore is unnatural. Besides, selection of a proper repeat address involves a complicated operation with a resulting high manufacturing cost. Since, particularly, the amplitude and phase of the last address are randomly determined by the memory size, seeking of a repeat address corresponding to such random amplitude and phase is extremely troublesome. Moreover, since waveshapes are all different from one another depending upon the tone pitch of a tone or the type of rhythm sound, such troublesome selection of the repeat address must be individually made for the respective different waveshapes, so that a very cumbersome and patient work is required.

A tone waveshape in the rise portion of a tone changes in a complicated manner, exhibiting a great difference from the relatively stable waveshape of a sustained portion. Accordingly, for generating a tone of a good quality, a waveshape of plural periods for the rise portion preferably is prepared separately from a waveshape of plural periods to be read out repeatedly and this rise portion is read out once and thereafter the repetitive portion is read out repeatedly. In this case too, some arrangement must be made to prevent the connection between the rise portion and the repetitive portion from becoming unnatural.

It is, therefore, an object of the present invention to realize, in a tone waveshape forming device in which the waveshape of plural periods of the rise portion is read once and thereafter the waveshape of plural periods of the repetitive portion is repeatedly read out, a smooth connection between the rise portion and the repetitive portion and also a smooth connection between the repetitive portions themselves.

It is another object of the invention to facilitate the selection of a waveshape of plural periods to be used as the repetitive portion.

As will be described later, the present invention employs the interpolation technique for achieving the above objects of the invention. Known in the art of tone waveshape generation utilizing interpolation is a technique disclosed in U.S. Pat. No. 4,036,096. In this patent, the same waveshape is stored in a coarse sample interval in basic value memories 11 and 12 thereby to achieve reduction in the memory capacity. Two adjacent sample points stored in the memories are interpolated in accordance with the following equation to obtain a sample value Y:

$$Y=A+(B-A)\cdot X(C)$$

Where A and B represent sample values of the two adjacent sample points and X(C) represents interpolation function according to which $X(C)=0$ when $C=0$, $X(C)=1$ when $C=1$ and $0 \leqq X(C) \leqq 1$ when $0 \leqq C \leqq 1$. For example, $X(C)=\frac{1}{2}(1-\cos \pi c)$. Thus, the known interpolation is one between the adjacent sample points. In the present invention, however, the interpolation is one which smooths the amplitude change of the waveshape in the interpolation section.

SUMMARY OF THE INVENTION

The tone waveshape forming device according to the invention is characterized in that it comprises waveshape generation means for generating first waveshape data and thereafter generating second waveshape data repetitively, said first waveshape data representing an attack portion of a tone waveshape corresponding to a tone to be produced and said second waveshape data representing a part of a portion succeeding said attack portion of said tone waveshape, said part succeeding said attack portion and including plural periods of said tone; interpolation section designation means for designating an interpolation section subject to an interpolation operation in said part, said interpolation section being a first narrow section before the end of said part and a second narrow section after the start of said part to be generated next; interpolation means for producing new waveshape data by performing an interpolation operation based on said second waveshape data during said interpolation section; and waveshape data outputting means for outputting said first waveshape and thereafter repetitively outputting said second waveshape data during the other section than said interpolation section in said part and said new waveshape data during said interpolation section.

Illustrating the above feature of the invention, the waveshape generation means generates the first waveshape and thereafter the second waveshapes repeatedly as shown in FIG. 1*a*. Since the first amplitude value and phase of the second waveshape and the last amplitude value and phase thereof are determined independently from each other, connection between the respective second waveshapes which are repeatedly generated is not continuous. FIG. 1*b* shows a finally obtained tone waveshape signal according to this invention. In a specified section A at the end of each repeated cycle of the second waveshape and a specified section B at the beginning of a next repeated cycle of the second waveshape, a tone waveshape signal based on an approximate value obtained by interpolation operation is used whereas in other sections, tone waveshape signals (waveshapes of FIG. 1*a*) based on the output of the waveshape generation means is used. The discontinuous line between the specified sections A and B indicates the second waveshape before the interpolation whereas the solid line represents the waveshape which has been determined by the interpolation. The specified sections A and B are sections adjacent to the connecting portion of the repeatedly generated second waveshapes. The connecting portion which has not been continuous and the waveshape sections adjacent thereto are smoothly interpolated by employing a waveshape based on an approximate value obtained by the interpolation operation in these sections whereby the connection of the repeated portions can be made smooth. Accordingly, the amplitude values and phases at the beginning and end of the second waveshapes need not coincide but may be selected as desired. Hence selection of the second waveshape is greatly facilitated. Since the first waveshape and the second waveshape are continuous waveshapes originally, connection between the rise portion and the repeated portion can be made smooth.

In the embodiment described below, waveshapes of desired plural periods of a rise portion is taken out of a desired original tone waveshape as the first waveshape and waveshapes of desired plural periods succeeding the first waveshape are taken out as the second waveshape. As the waveshape generation means, a memory prestoring sample amplitude data of the first and second waveshapes at successive addresses is used. In this case, an address at which the first amplitude data of the first waveshape is stored is referred to as a start address, an address at which the first amplitude data of the second waveshape is stored as a repeat address, an address at which the last amplitude data of the second waveshape is stored as an end address and an address corresponding to the beginning of the section A as an interpolation start address, respectively. The waveshape generation means is not limited to the above memory but a device which generates waveshape signals equivalent to the first and second waveshapes by combination of a data memory and an operation circuit, or other type of waveshape generation device may be employed.

In the embodiment described below, a method employing averaging operation is described as the interpolation operation. Any other type of interpolation operation may however be employed as the interpolation operation of the invention if it can smoothly connect discontinuous waveshapes.

In another aspect of the invention, the same effect can be obtained by performing the above described interpolation operation and prestoring resulting waveshape amplitude data in a waveshape memory. More specifically, waveshapes of plural periods (e.g. the second waveshape in FIG. 1*a*) are taken out of a desired original waveshape, a predetermined interpolation operation is made with respect to a section ranging from a specified section (e.g. the section A in the figure) at the end of the taken out waveshape to a specified section (e.g. the section B) at the beginning of the same waveshape by using waveshape sample amplitude data of the same section. A waveshape produced by connecting a waveshape portion consisting of the waveshape sample amplitude data obtained by the interpolation operation to the beginning or end of the waveshape resulting from removing the specified sections A and B from the waveshape which has been taken out first is previously stored in a waveshape memory and this waveshape is repeatedly accessed. For smoothing the connecting portion between the waveshape of the rise portion and the repetitive waveshape portion, the waveshape portion obtained by the interpolation operation may be connected to the end of the waveshape resulting from removing the specified sections A and B from the second waveshape and the resulting waveshape may be stored in the waveshape memory. An example of such repetitive waveshape to be stored in the waveshape memory is shown in section C in FIG. 1*b*. In this case, the waveshape shown in section D in FIG. 1*b* may be separately stored in a waveshape memory as the waveshape of the rise portion.

The term "plural periods" does not mean that the number of periods is limited to integer but it may include a fraction of a period. Time length of respective periods may also vary. The term "specified sections at the end and beginning of the second waveshape" does not mean that the length of these sections is defined by a certain absolute value but means sections at the end and beginning of the repeated portion for which the interpolation operation is performed or sections in which the result of the interpolation operation is utilized for forming of a tone.

BRIEF DESCRIPTION OF THE DRAWINGS

In the accompanying drawings.

DESCRIPTION OF PREFERRED EMBODIMENTS

Figures 1A, 1B:
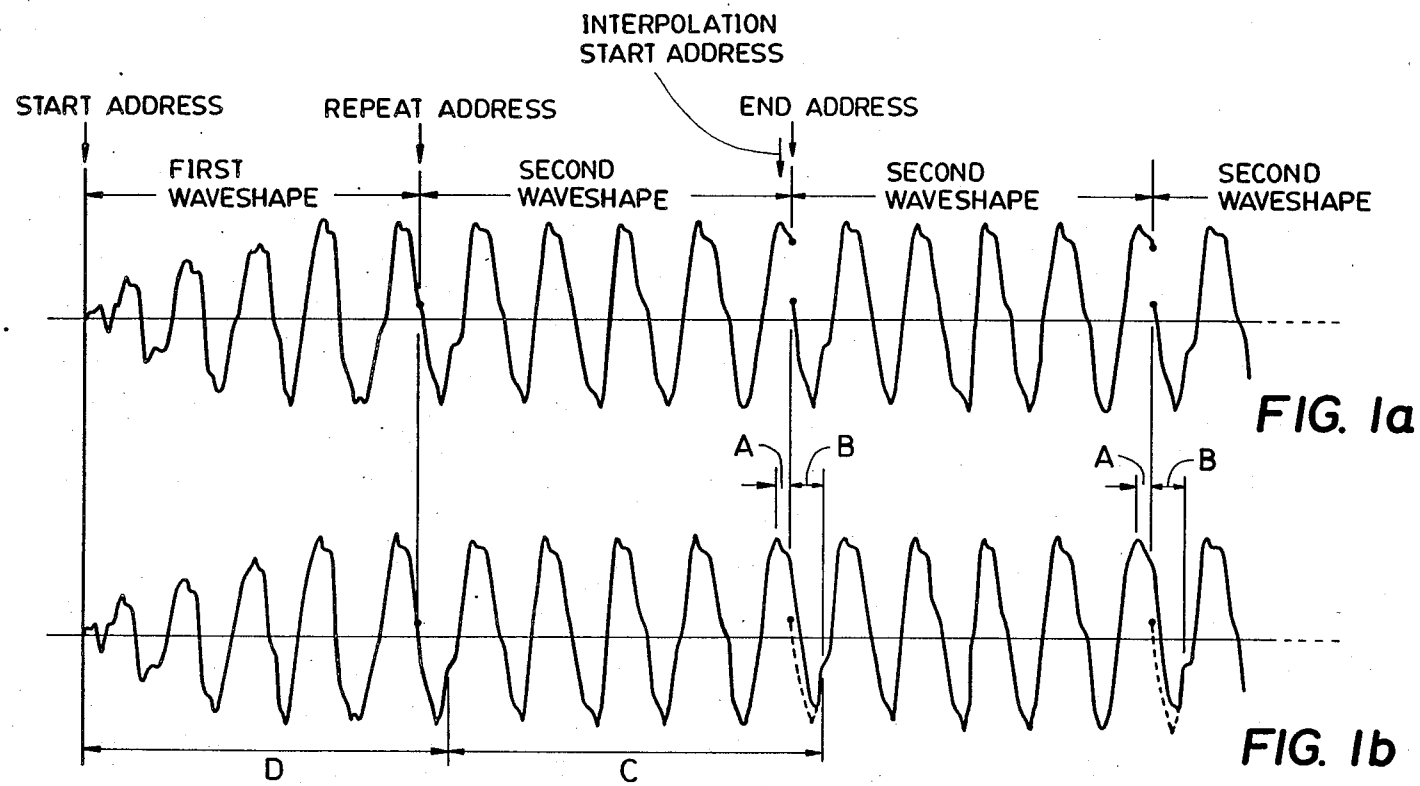
FIG. 1 shows waveshape diagrams for explaining the outline of the tone waveshape forming according to the invention.
Figure 2:
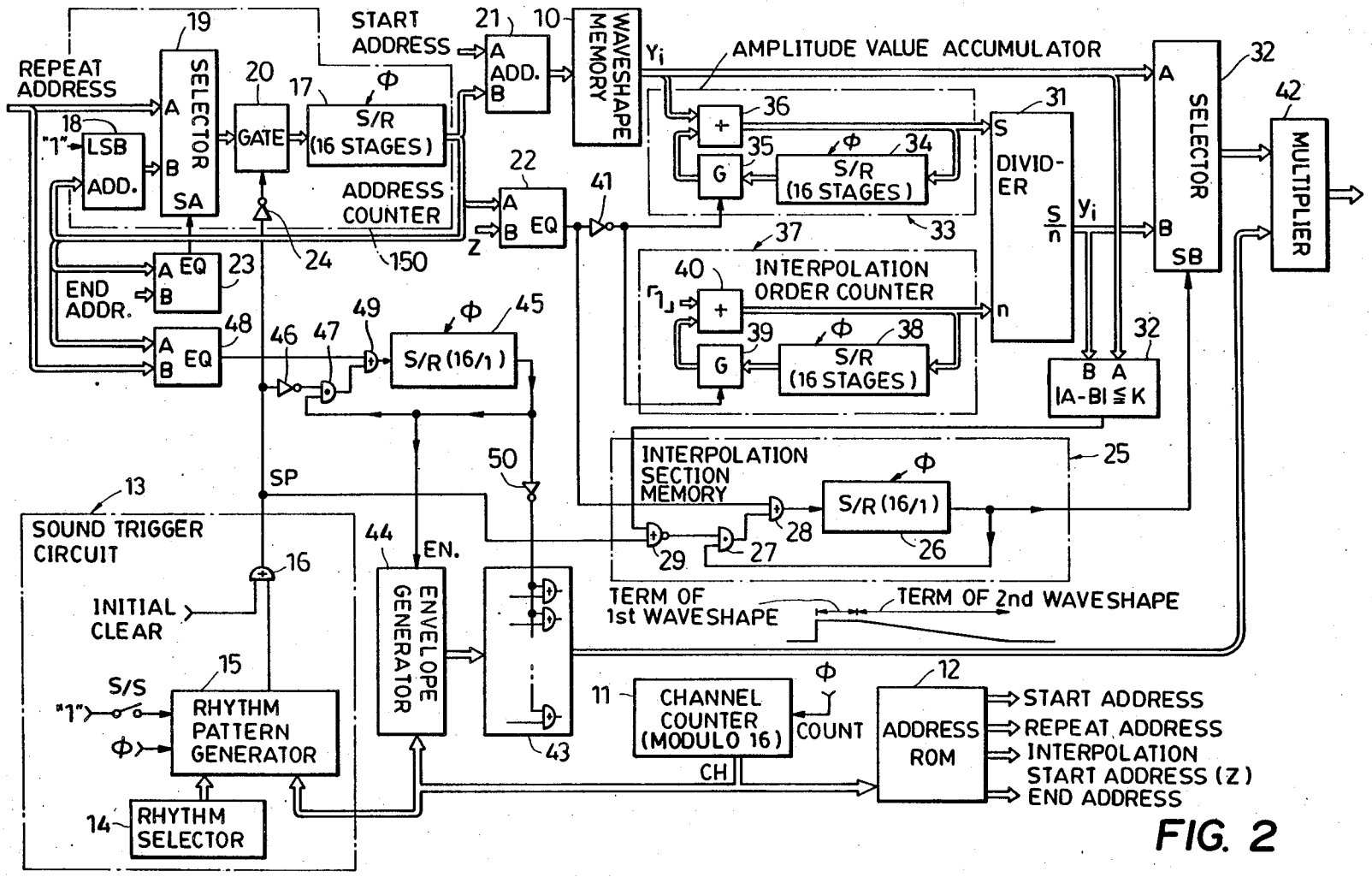
FIG. 2 is an electrical block diagram showing an embodiment of the invention.

FIG. 2 shows an embodiment of the invention as applied to the formation of percussion instrument tones by an automatic rhythm performing apparatus, in which an averaging operation is used as the interpolation operation such that the interpolation order is increased gradually from the start of interpolation through its end. The principle of the interpolation operation used in the embodiment will be first described with reference to FIG. 3.

Figure 3:
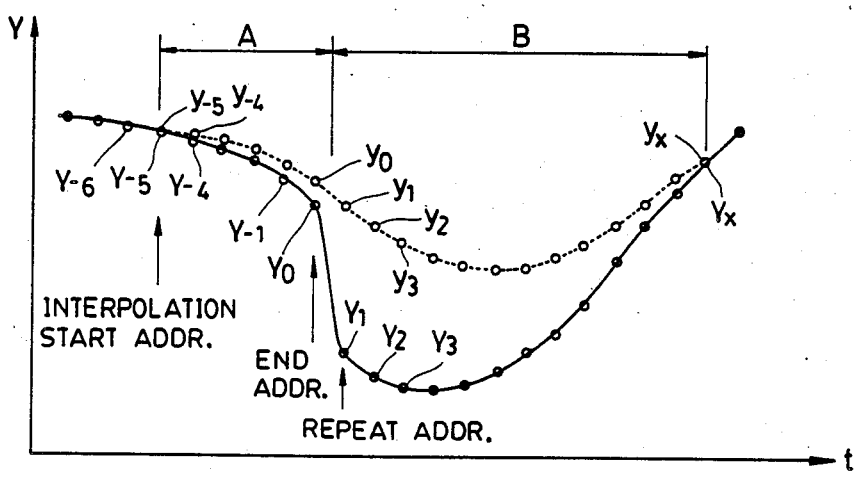
FIG. 3 is a waveshape diagram showing an example of the interpolation operation in the same embodiment.

In FIG. 3, the horizontal axis t indicates the lapse of time while the vertical axis Y the waveshape amplitude level. The capital letters Y with a suffix number designate the waveshape amplitude values at the respective sample points which are read out from a waveshape memory while the small letters y with a suffix number designate the waveshape amplitude values at the respective sample points obtained by the interpolation operation. FIG. 3 shows the end of a certain repetitive cycle (affixed with suffix number −6 to 0) and the beginning of the following repetitive cycle (affixed with suffix numbers 1, 2, 3 . . . ). For example, the interpolation start address (suffix number −5) is five addresses ahead of the end address (suffix number 0).

The interpolation values $y_{-5}$, $y_{-4}$, $y_{-3}$ . . . at the respective sample points are obtained by the interpolation operation such that, as shown below, the waveshape amplitude values $Y_{-5}$, $Y_{-4}$ . . . between the interpolation start address and the respective sample points corresponding to the interpolation values to be obtained are added together and then divided by the number of sample points (addresses) (the number being called the interpolation order) to obtain the mean value. Therefore, the interpolation order increases as the interpolation advances.

$$y_{-5} = Y_{-5} \quad \text{(start of the interpolation)}$$

$$y_{-4} = \frac{Y_{-5} + Y_{-4}}{2}$$

$$y_{-3} = \frac{Y_{-5} + Y_{-4} + Y_{-3}}{3}$$

.

.

.

$$y_0 = \frac{Y_{-5} + Y_{-4} + Y_{-3} + Y_{-2} + Y_{-1} + Y_0}{6}$$

$$y_1 = \frac{Y_{-5} + Y_{-4} + Y_{-3} + Y_{-2} + Y_{-1} + Y_0 + Y_1}{7}$$

$$y_2 = \frac{Y_{-5} + Y_{-4} + Y_{-3} + Y_{-2} + Y_{-1} + Y_0 + Y_1 + Y_2}{8}$$

.

.

.

As is obvious from the graph, due to the averaging operation, the interpolation values $y_{-5}$, $y_{-4}$ . . . form a more moderate curve than the read values $Y_{-5}$, $Y_{-4}$ . . . of the waveshape memory, so that the gaps in the repetitive waveshape can be connected smoothly. Because of the polarity of the slope of the waveshape curve alternates, the interpolation value $y_x$ either approaches or coincides with the original waveshape amplitude value $Y_x$ in the end. When the interpolation value $y_x$ has approached the original waveshape amplitude value $Y_x$ within a given tolerance k, i.e., when $|Y_x - y_x| \leqq k$ is attained, the interpolation terminates. More specifically, the interpolation is effected in a section A from the interpolation start address (corresponding to $Y_{-5}$) to the end address (corresponding to $Y_0$) and in a section B from the repeat address (corresponding to $Y_1$) to the address corresponding to $Y_x$. In this embodiment, the interpolation address is determined while the interpolation end address (corresponding to $Y_x$) varies with the waveshape.

In FIG. 2, a waveshape memory 10 stores waveshapes of several kinds (e.g. 16 kinds) of percussion instrument tones. As described before, each kind of waveshape consists of a first waveshape composed of waveshapes of plural periods at the rise portion and a second waveshape composed of the succeeding waveshapes of plural periods. The sample point amplitude data composing this waveshape is stored in successive addresses. As mentioned above, these first and second waveshapes can be readily obtained by taking out a predetermined section from the rise portion of the original percussion instrument tone waveshape. In this case, the memory areas assigned to the respective waveshape can be fully used to store the waveshapes. As described before, the start address, repeat address, interpolation start address, and end address are provided for each waveshape so as to specify the memory area for the first waveshape which is read only once, the memory area for the second waveshape which is read repeatedly, and the address at which the interpolation operation is started.

Figure 4:
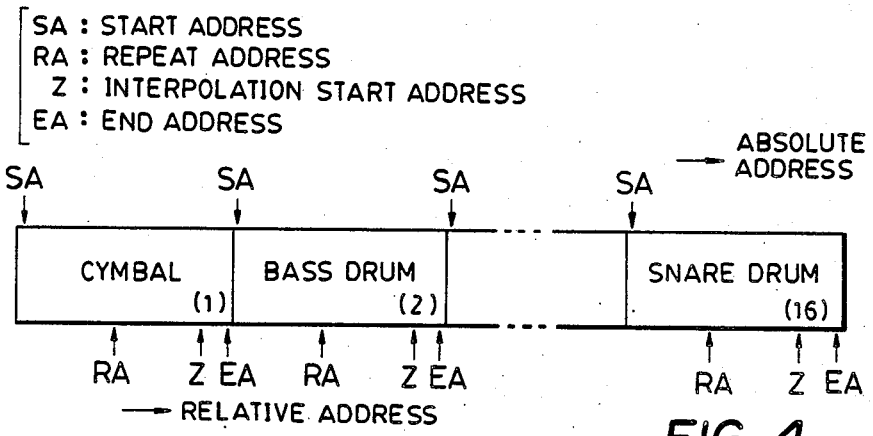
FIG. 4 is a diagram showing schematically a memory map of a waveshape memory of FIG. 2.

FIG. 4 shows the memory map of the waveshape memory 10, in which a memory area 16 stores 16 kinds of percussion instrument tones (cymbal, bass drum, snare drum, etc.). The first address in the memory area of each waveshape is specified by the start address which is an absolute address. The repeat address, interpolation start address, and end address for each waveshape are designated by relative addresses (i.e., addresses with the start address at 0) in the memory area for each waveshape.

In FIG. 2 again, the tone signals corresponding to the sixteen kinds of waveshapes are each assigned to sixteen time division time slots respectively so as to be formed in time division. The time division timing is set by a clock pulse $\phi$. A hexadecimal channel counter 11 counts the clock pulse $\phi$ and produces a channel timing signal CH designating the respective time division processing channel (time slots) of the sixteen kinds of waveshapes. An address ROM (read-only memory) 12 stores data designating the start address, repeat address, interpolation start address and end address for each of the sixteen kinds of waveshapes. The values of these addresses are peculiar to the respective waveshapes. The interpolation start address, as mentioned before, is ahead of the end address by a given number of addresses. The address ROM 12 reads these addresses for each waveshape in time division according to the channel timing signal CH. Therefore, in a channel timing (time slot) to process a certain waveshape, the ROM 12 reads data of the addresses corresponding to that waveshape in parallel.

A sound trigger circuit 13 is provided to order the start of sounding in the individual channels of the percussion tones assigned to the respective channels. This circuit 13 comprises a rhythm selector 14 and a rhythm pattern generator 15. As is known, upon selection of a rhythm by the rhythm selector 14, the rhythm pattern generator 15 produces the sounding timing pulses of the respective percussion instrument tones (the respective percussion instrument tones as used for the rhythm selected) in the sounding pattern corresponding to that rhythm. The channel timing signal CH is supplied to the rhythm pattern generator 15, so that the sounding timing pulses of the respective percussion instrument tones are produced in time division in synchronism with the time slots of the channels to which those pulses are assigned. The sounding timing pulses produced from the generator 15 are supposed to become "1" at the start of sounding for one period of the clock pulse $\phi$ (i.e., one time slot). The output of the rhythm pattern generator 15 is produced as a start pulse SP via an OR gate 16. The OR gate 16 is provided at its other input with an initial clear signal which maintains "1" during the sixteen time slots when the power is supplied. The initial clear signal is used to initially reset all the stages of each shift register shown in FIG. 2. The rhythm pattern generator 15 is enabled upon closing of a start/stop switch, then the automatic rhythm performance starts. The address counter 150 is composed of a sixteen stage shift register 17 shift-controlled by the clock pulse, adder 18, selector 19 and gate 20. This address counter 150 is provided to designate the read address in the waveshape memory 10 with a relative address. The start address read out from the address ROM 12 is applied to an adder 21, the repeat address is applied to the A input of the selector 19, the interpolation start address (designated by Z) is applied to the B input of a comparator 22 and the end address is applied to the B input of a comparator 23. The read address designating data of a relative address form produced from the address counter 150 (shift register 17) is supplied to the adder 21 and thereby added with the start address so as to be converted into the absolute address form. The output of the adder 21 is applied to the waveshape memory 10 as the absolute form of read address designating data.

The shift register 17 is provided to temporarily store the read address designating data of each channel in time division, the last-stage output signal thereof indicating the relative address data of the read address in the present processed channel. The adder 18 adds "1" to the least significant bit LSB of the read address data produced from the shift register 17 so as to advance the read address by one address. The output of the adder 18 is selected by the selector 19 through the B input and applied to the shift register 17 through the gate 20. The gate 20 is controlled by the signal obtained by inverting the start pulse SP from the sounding trigger circuit 13 by an inverter 24.

The output of the shift register 17 is applied to the A input of the comparator 23, whose coincidence output EQ is supplied to the A select control input SA of the selector 19. While the read address is not coincident with the end address, the coincidence output EQ is "0" so that the selector selects the B input. When the read address coincides with the end address, EQ is turned to "1" so that the selector 19 selects the repeat address data through the A input.

Accordingly, the addresses in the address counter change in the following manner. First, when the initial clear signal is generated, the gate 20 is closed during 16 time slots and all the stages of the shift register 17 are cleared. At the sounding timing of a certain percussion tone, the start pulse SP is turned to "1" at the corresponding channel timing to close the gate 20 so only the contents of the shift register 17 corresponding to that channel are cleared. In that particular channel, the output (the relative address) of the shift register 17 is initially "0" so that the same data as that in the start address is supplied to the waveshape memory 10. The relative address data increases by one every 16 time slots while the read address (absolute address) of the waveshape memory 10 increases by one from the start address. Thus, the waveshape memory 10 reads out the sample amplitude data of the first waveshape, followed by the sample amplitude data of the second waveshape. When the first and second waveshapes have been read out and the read address reaches the end address, the output EQ of the comparator 23 is turned to "1" so that the repeat address data is set in the shift register 17 corresponding to that channel. Accordingly, the read address returns from the end address to the repeat address so that the second waveshape may be read out. This control is repeated so that the second waveshape may be read out repeatedly.

The A input of the comparator 22 is supplied with the output of the shift register 17. When the read address reaches a predetermined interpolation start address Z, the coincidence output EQ of the comparator 22 becomes "1", whereon the interpolation operation is started. An interpolation section memory 25 stores the signal "1" in the period in which to form tones based on the interpolation operation result and is provided with a 16-stage/1-bit shift register 26 to store the interpolation section signal in each channel. The output of the shift register 26 is held through an AND gate 27 and OR gate 28. When the start pulse SP is generated, the output of the shift register 26 in the "1" state is inverted by an OR gate 29 and applied to the AND gate 27 to clear the memory. Therefore, when the sounding of the percussion tones is started in a certain channel, the contents of the shift register 26 corresponding to that channel are cleared to "0". The output of the shift register 26 is applied to the B select control input SB of a selector 30, which selects the read out waveshape of the waveshape memory 10 through the A input when the output of the shift register 26 is "0" and selects and interpolation operation result supplied through the B input from a divider 31 when that output is "1". The output signal of the comparator 22 is applied to the shift register 26 through the OR gate 28 so as to set the contents of the shift register 26 to "1" at the start of the interpolation operation. This signal "1" is held through the AND gate 27 and OR gate 28. As will be described, when a comparator 32 detects the termination of the interpolation, the output signal "1" of the comparator 32 is inverted by a NOR gate 29 to disable the AND gate 27, thereby resetting the signal "1" which designates the interpolation section.

An amplitude value accumulator 33 is provided to successively add the respective waveshape sample amplitude data from the interpolation start address. The accumulator 33 comprises a 16-stage/plural-bit shift register 34, gate 35, and an adder 36 which adds the output of the shift register 34 supplied through the gate 35 and the read out output of the waveshape memory 10. The output of the adder 36 is stored in the shift register 34 on one hand and supplied to the dividend input S of the divider 31 on the other.

An interpolation order counter 37 is provided to obtain the interpolation order by counting the number of addresses following the interpolation start address. The counter 37 comprises a 16-stage/plural-bit shift register 38, gate 39, and an adder 40 which adds "1" to the least significant bit of the output data of the shift register 38 supplied through the gate 39. The output of the adder 40 is stored in the shift register 38 on one hand and supplied to the divisor input n of the divider 31 on the other.

The inverse of the signal from the coincidence output EQ of the comparator 22 through an inverter 41 is supplied to the control inputs of the gates 35 and 39. Therefore, when the read address reaches the interpolation start address Z, the gates 35 and 39 are closed and the stored data in the shift registers 34 and 38 corresponding to the relevant channel is cleared. Then the gates 35 and 39 are enabled to perform the accumulation operation. Therefore, the amplitude value accumulator 33 successively accumulates the waveshape sample amplitude data following that of the interpolation start address Z while the interpolation order counter 37 counts the number of addresses (samples) of the accumulated amplitude data. The divider 31 executes the division S/n in each time slot. Accordingly, the interpolation operation of the averaging operation type in which the interpolation order increases gradually as described before is performed as the waveshape read address after the interpolation start address advances. As mentioned previously, during this interpolation operation, the selector 30 selects the B input so as to produce an interpolation operation result $y_i$ supplied from the divider 31. The comparator 32, provided to detect the termination of the interpolation, is supplied at the A input with the read out output $Y_i$ of the waveshape memory 10 and at the B input with the output $y_i$ of the divider 31. The comparator 32 produces the signal "1" when the absolute value of the difference between the A input and the B input is equal to or smaller than predetermined small data indicating the given tolerance k, i.e., when $|A-B| \leqq k$ (i.e., $|Y_i-y_i| \leqq k$). As mentioned before, this signal "1" is inverted by the NOR gate 29 to reset the memory of the shift register 26. Accordingly, upon termination of the interpolation, the selector 30 is switched to select the A input to select and produce the output $Y_i$ of the waveshape memory 10.

The output of the selector 30 is supplied to a multiplier 42 and multiplied by an envelope signal provided from an envelope generator 44 through OR gate group 43. The envelope generator 44 is controlled by the output of a shift register 45 and enabled while the second waveshape (repetitive waveshape) is being generated. When the start pulse SP is generated, the output of an inverter 46 is turned to "0" so that an AND gate 47, which is provided to hold the shift register 45, is disabled and the stored signal in the shift register 45 of the corresponding channel is reset to "0". In the meantime, as mentioned above, the waveshape memory 10 starts readout of the first waveshape (the waveshape of the rise portion) based on the start pulse SP. A comparator 48 compares the output of the address counter (shift register 17) and the repeat address and, when they coincide, produces the signal "1" which is applied to the shift register 45 through an OR gate 49. Therefore when the first waveshape has been read throughout and the read address becomes the first address of the second waveshape, i.e., the repeat address, "1" is set in the corresponding channel of the shift register 45 and held through the AND gate 47.

The output of the shift register 45 is inverted by an inverter 50 and applied to the OR gate group 43. The OR gate group 43 comprises a plurality of OR gates corresponding in number to the output bits of the envelope generator 44. The OR gates 43 are each separately supplied with the respective bits of the output of the envelope generator 44 and also provided in common with the output of the inverter 50. Therefore, while the first waveshape is being read out, the output of the inverter 50 is "1" because of the output "0" of the shift register 45 and the outputs of the OR gate group 43 are all "1". Thus, as to the first waveshape, the multiplier 42 produces the signal that is read out from the waveshape memory 10 unaltered without effecting the amplitude control. Since the first waveshape stored in the waveshape memory 10 has been provided beforehand with the envelope of the rise portion, the multiplier 42 need not effect the envelope providing control.

While the second waveshape is being read out repeatedly, the shift register 45 produces the signal "1" so that the envelope generator 44 is enabled to generate a decay envelope shape. The envelope generator 44 is supplied with the channel timing signal CH so as to generate the envelope shapes for the respective channels in time division. In the meantime, the output of the inverter 50 is "0" so that the decay envelope shape data produced from the envelope generator 44 is passed through the OR gate group 43 and supplied to the mulitplier 42. Thus, the repeatedly read out second waveshape is provided with the decay envelope.

Figure 5:
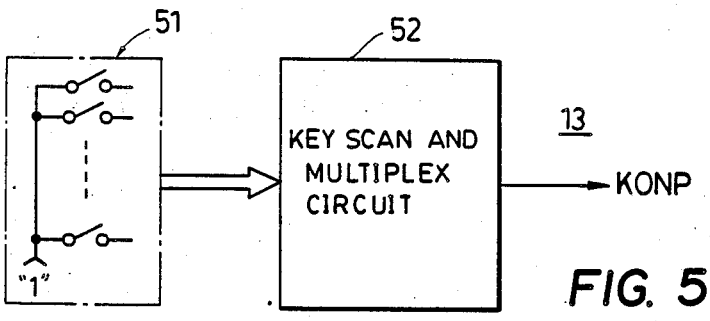
FIG. 5 is a block diagram showing a modified example of a sounding trigger circuit of FIG. 2 which has been modified for forming a scale note.

The circuit as shown in FIG. 2 can be also used to generate scale notes. In that case, the sounding trigger circuit 13 is modified, for example, as shown in FIG. 5. A key scan and multiplex circuit 52 scans key switches 51 of the respective keys on the keyboard to detect the depressed key and generates a key-on pulse KONP at the moment of depression. The keys are assigned predetermined time slots respectively and the key-on pulses KONP of the respective keys are produced in the respective time slots in time division miltiplex. The key-on pulse KONP can be applied to each circuit shown in FIG. 2 in place of the start pulse SP. For example, where the keyboard has 61 keys, the key-on pulse KONP is a time division miltiplex signal. Therefore, the shift registers 17, 26, 34, 38 and 45 shown in FIG. 2 are modified so as to be provided respectively with 61 stages while the channel counter 11 is modified so as to be modulo 61. Further modifications are made so that the waveshape memory 10 stores waveshapes for 61 keys respectively and the address ROM 12 stores 61 kinds of address data.

Figure 6:
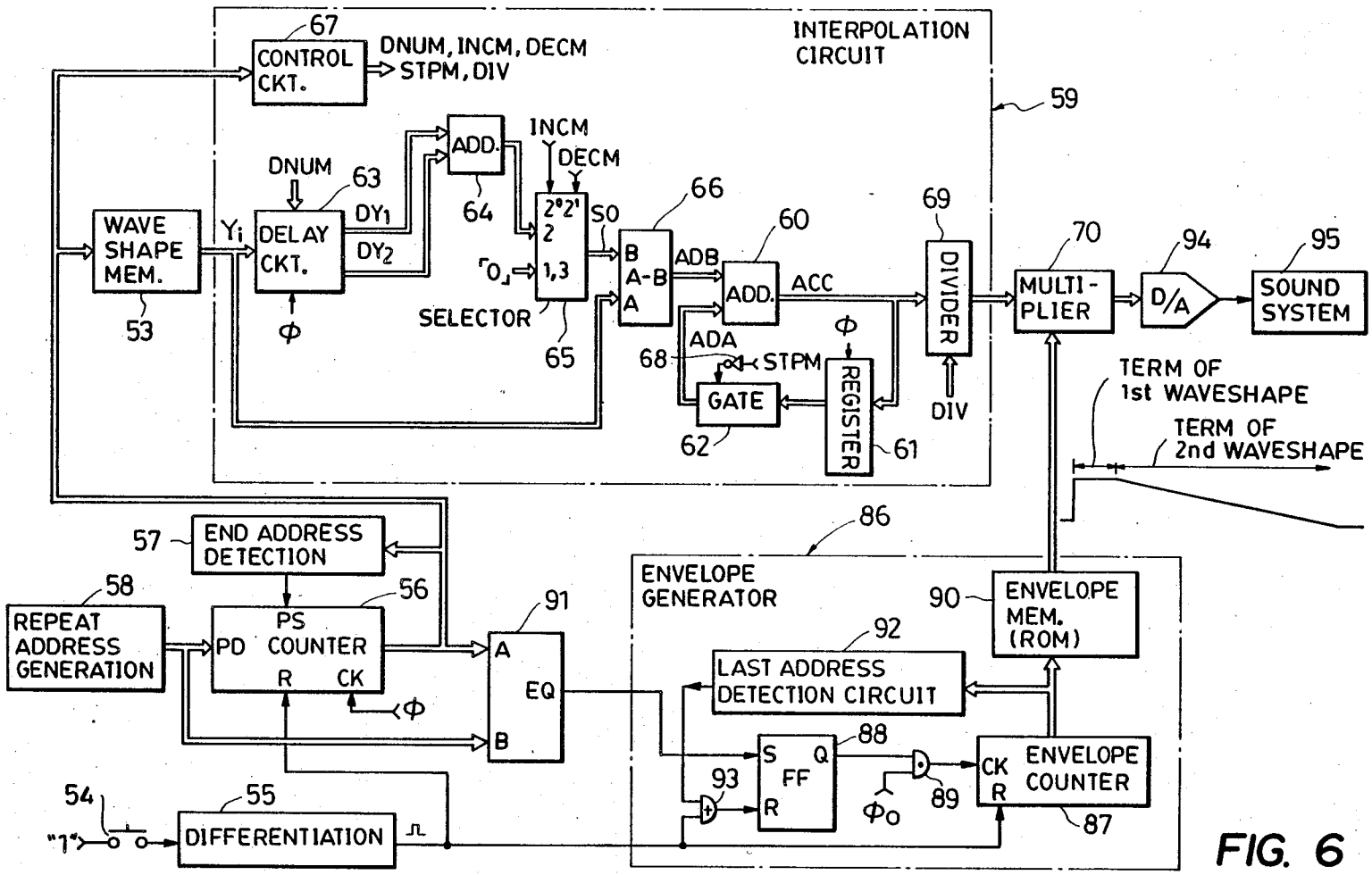
FIG. 6 is an electrical block diagram showing another embodiment of the invention.

FIG. 6 shows an embodiment to perform an interpolation operation different from that performed by the embodiment shown in FIG. 2. To simplify the explanation, a waveshape memory 53 is made to store only one kind of the first and the second waveshapes. The readout from the memory 53 starts when a start switch 54 is closed. In this embodiment, while the interpolation operation performed is an averaging operation similar to that in the previous embodiment, the interpolation order increases for a predetermined period from the start of the interpolation and decreases gradually thereafter. Shown below is an example of interpolation operation by the embodiment illustrated in FIG. 6, in which Y with a suffix number designates waveshape amplitude value data at each sample point read from the waveshape memory 53, y with a suffix number designates the waveshape amplitude value data at each sample point obtained by the interpolation operation, the suffix number 0 corresponds to the end address, the suffix number 1 corresponds to the repeat address, the suffix number −3 corresponds to the interpolation start address, these suffix numbers increasing as the sample order (address) advances, and a maximum interpolation order is 6.

$$y = Y_{-3} \quad \text{(start of the interpolation)}$$

$$y_{-2} = \frac{Y_{-3} + Y_{-2}}{2}$$

$$y_{-1} = \frac{Y_{-3} + Y_{-2} + Y_{-1}}{3}$$

$$y_0 = \frac{Y_{-3} + Y_{-2} + Y_{-1} + Y_{-0}}{4}$$

$$y_1 = \frac{Y_{-3} + Y_{-2} + Y_{-1} + Y_0 + Y_1}{5}$$

$$y_2 = \frac{Y_{-3} + Y_{-2} + Y_{-1} + Y_0 + Y_1 + Y_2}{6}$$

$$y_3 = \frac{Y_{-1} + Y_0 + Y_1 + Y_2 + Y_3}{5}$$

$$y_4 = \frac{Y_1 + Y_2 + Y_3 + Y_4}{4}$$

$$y_5 = \frac{Y_3 + Y_4 + Y_5}{3}$$

$$y_6 = \frac{Y_5 + Y_6}{2}$$

$$y_7 = Y_7 \quad \text{(end of the interpolation)}$$

As is obvious from the above equations, the mean value can be obtained by adding the amplitude values at the present sample point and at some immediately preceding sample points and dividing the sum of these amplitude values by the number of sample points. Accordingly, while the interpolation degree increases, the sum of amplitude values (e.g., $Y_{-3}+Y_{-2}+Y_{-1}$) in the interpolation operation at the present sample point is obtained merely by adding the sum of amplitude values (e.g., $Y_{-3}+Y_{-2}$) in the interpolation operation at the preceding sample points and the amplitude values (e.g., $Y_{-1}$) at the present sample point. While the interpolation order decreases, the sum of the amplitude values (e.g., $Y_5+Y_6$) in the interpolation operation at the present sample point is obtained by subtracting the amplitude values (e.g., $Y_3$, $Y_4$) at the oldest two sample points from the sum of the amplitude values in the interpolation operation at the preceding sample points and adding to the obtained difference the amplitude values (e.g., $Y_6$) at the present sample point.

According to this interpolation method, the number of samples (addresses) in the interpolation section is constant and, as compared to the example shown in FIG. 2, the interpolation terminates earlier (i.e., the interpolation value $y_i$ reaches the original amplitude value $Y_i$ earlier). Also, because the interpolation does not terminate unless the interpolation value $y_i$ reaches the real amplitude value $Y_i$, the waveshape connects in an improved manner at the connection where the waveshape data obtained by the interpolation operation switches over to the waveshape data read out from the memory.

In FIG. 6, upon closing of the start switch 54, a differentiation circuit 55 produces one shot of pulse to reset an address counter 56. Then the counter 56 starts counting the clock pulse $\phi$ so that the count increases from "0" gradually. The count output of the counter 56 is supplied to an end address detection circuit 57. When the count reaches a predetermined end address, said detection circuit 57 supplies the signal "1" to the present control input PS of the counter 56. A repeat address generation circuit 58 supplies a given repeat address data to the preset data input PD of the counter 56. When the signal "1" is supplied to the input PS, the repeat address data is preset in the counter 56 through said input PD. Thus, the count of the address counter 56 once gradually increases from the start address (count 0) through the end address, thereafter repeatedly increasing from the repeat address up to the end address. The output of the counter 56 is added to the address input of the waveshape memory 53, which reads out the first waveshape (the waveshape at the rise portion) throughout and then the second waveshape repeatedly. The waveshape data which is read out from the waveshape memory 53 is supplied to an interpolation circuit 59, which performs the interpolation operation as described before (i.e., the interpolation operation in which the interpolation order gradually increases before it decreases gradually) for a predetermined interpolation operation period from the interpolation start address. In the interpolation circuit 59, an adder 60, a register 61 for temporarily storing the output of the adder 60 according to the clock pulse $\phi$, and a gate 62 for supplying the output of the register 61 to the adder 60 constitute an accumulator for adding the waveshape sample amplitude value $Y_i$, which is read out from the waveshape memory 53, for a plurality of sample points. A delay circuit 63 for delaying the read output $Y_i$ of the waveshape memory 53, an adder 64 for adding the two outputs $DY_1$, $DY_2$ of the delay circuit 63, a selector 65 for selecting either the output of the adder 64 or the value 0, and a subtractor 66 are provided to subtract the amplitude values at the oldest two sample points from the stored value in the accumulator (adder 60, register 61 and gate 62) while the interpolation order is decreasing gradually.

The output of the selector 65 is supplied to the B input of the subtractor 66 whose A input is supplied with the waveshape sample amplitude value $Y_i$ which is read out from the waveshape memory 53. The subtractor 66 performs subtraction A−B. The output of the subtractor 66 is supplied to the adder 60 and thereby added to the output of the register 61 (the sum of amplitude values up to the present sample point) supplied through the gate 62.

A control circuit 67 detects the arrival of the read address of the waveshape memory 53 at a predetermined interpolation start address based on the address data supplied from the address counter 56, starts the interpolation control operation and generates signals DNUM, INCM, DECM, STPM and DIV for controlling the operations of the respective circuits. The delay stage number signal DNUM is supplied to the delay circuit 63 to control the selection of the stages from which the delay signals are produced as the outputs $DY_1$ and $DY_2$ (or control the determination of the number of samples by which the waveshape amplitude values to be produced as $DY_1$ and $DY_2$ precede the present value). The increasing mode signal INCM and the decreasing mode signal DECM are applied to the 2-bit selection control inputs of the selector 65 and become selection signals with the respective weights of $2^0$ and $2^1$. When the selection signal is "2" is decimal, i.e., when INCM="0" and DECM="1", the output of the adder 64 is selected by the selector 65 and applied to the subtractor 66. This occurs in the mode in which the interpolation order decreases gradually. When the selection signal is decimal 1 or 3, i.e., when INCM="1" and DECM="0" or INCM="1" and DECM="1", the selector 65 selects the data indicating "0". This occurs when no interpolation is effected or in the mode in which the interpolation order increases gradually.

The stop mode signal STPM is "1" when no interpolation is being effected and falls to "0" at the start of the interpolation and returns to "1" at the termination of the interpolation. The signal STPM is inverted by an inverter 68 before being supplied to the control input of the gate 62. Therefore during the interpolation operation, the gate 62 is kept open by the signal STPM in the 0 state, enabling the amplitude values accumulation operation using the adder 60 and register 61. The interpolation order signal DIV indicates the order of the interpolation operation at the present sample point (the number of samples of the accumulated amplitude values contained in the output of the adder 60) and is supplied to the divisor input of a divider 69. The divider 69 which is supplied at its dividend input with the output of the adder 60 (i.e., accumulated amplitude values for the number of samples indicated by the signal DIV) performs such averaging operation as described above.

The operation of the interpolation circuit 59 may be summarized as follows. While the interpolation is not being effected, the selector 65 selects the value 0 so the subtractor 66 virtually does not perform subtraction, allowing the amplitude value $Y_i$ read out from the waveshape memory 53 to pass therethrough unaltered. The stop mode signal STPM in the "1" state keeps the gate 62 open so that the adder 60 virtually does not perform addition, allowing the output of the subtractor 66 to pass therethrough unaltered. In the meantime, the interpolation order DIV indicates "1" so that the divider 69 virtually does not perform division, passing the output of the adder 60 therethrough intact. Thus waveshape sample amplitude data $Y_i$ read out from the waveshape memory 53 is passed through the interpolation circuit 59 unaltered and supplied to a multiplier for imparting the envelopes.

Upon starting the interpolation operation, the stop mode signal STPM is turned to "0" and the gate 62 is opened so that the accumulator consisting of the adder 60 and register 61 starts accumulating the waveshape amplitude value $Y_i$. While the interpolation order is increasing gradually, because the increasing mode signal INCM is "1", the selector 65 selects the value 0 so that the subtrator 66 virtually does not perform subtraction, allowing the read output $Y_i$ from the waveshape memory 53 to pass therethrough unaltered. Accordingly, while the interpolation degree gradually increases, the waveshape sample amplitude values $Y_i$ read out from the waveshape memory 53 are added successively. In the meantime, the value of the interpolation order signal DIV increases gradually and the mean value is obtained by the divider 69 and supplied to the multiplier 70. While the interpolation order decreases gradually, the decreasing mode signal DECM is "1" so that the selector 65 selects the output of the adder 64. Therefore, the subtractor performs subtraction "A−B" or $Y_i - DY_1 - DY_2$", i.e., subtracts the sum of the outputs $DY_1$ and $DY_2$ of the delay circuit 63 from the read output $Y_i$ of the waveshape memory 53. The output of the subtractor 66 is added by the adder 60 to the accumulated amplitude values up to the present sample points. Thus, the operation virtually performed is such that the amplitude values at the oldest two sample points are subtracted from the accumulated amplitude values up to the immediately preceding sample points and the amplitude value at the present sample point is added to the obtained difference. By such an operation, the sum of the amplitude values at the present sample point and several immediately preceding sample points can be obtained in respect of each sample point by gradually decreasing the number of sample points. In the meantime, the value of the interpolation order signal DIV also decreases gradually and the mean value is obtained by the divider 69.

Figure 7:
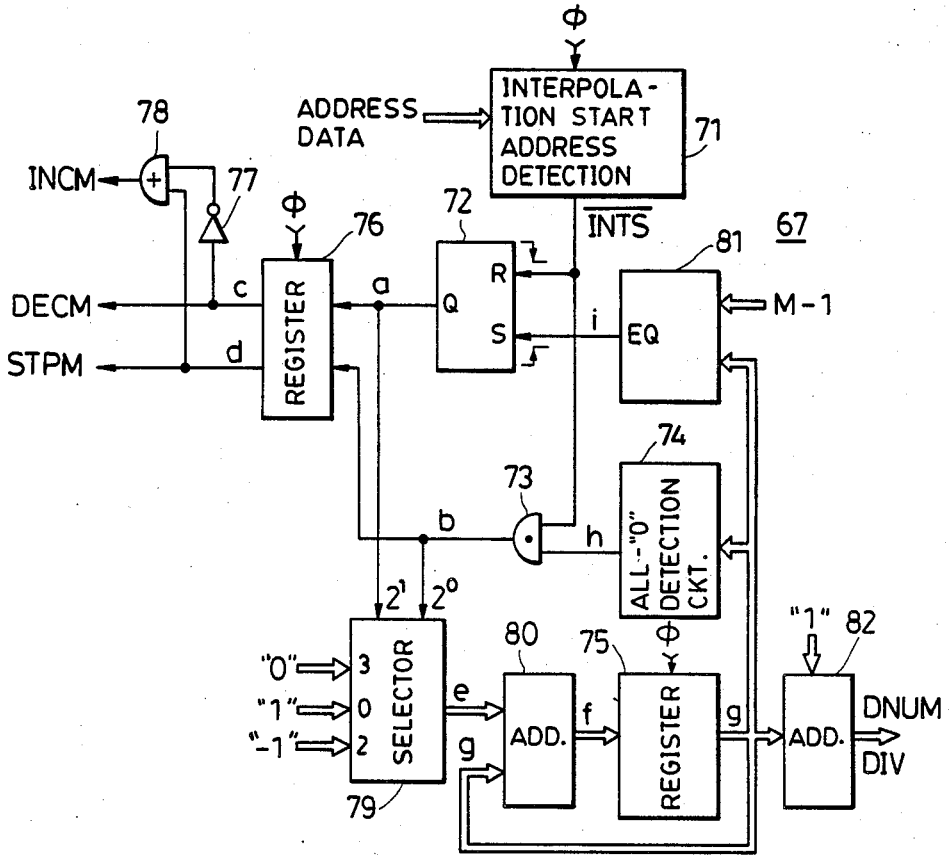
FIG. 7 is a block diagram showing an example of a control circuit of FIG. 6.
Figure 8:
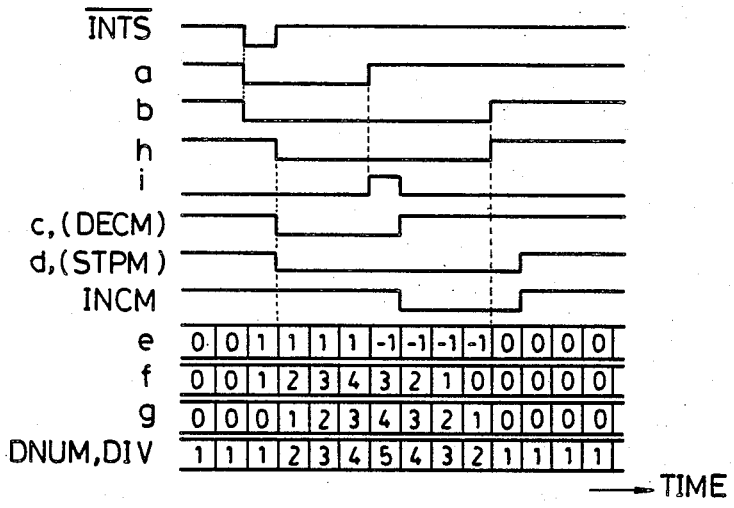
FIG. 8 is a time chart of signals appearing in some portions of the control circuit for describing an example of operation of the control circuit.

The control circuit 67 can be constituted, for example, as shown in FIG. 7. The address data generated by the address counter 56 is supplied to an interpolation start address detection circuit 71 which produces a negative interpolation start pulse $\overline{INTS}$ as shown in FIG. 8 when the address data coincides with a given interpolation start address. When this negative pulse $\overline{INTS}$ falls from "1" to "0", a flip-flop 72 is reset and its output Q falls to "0" as shown in FIG. 8*a*. The interpolation start pulse $\overline{INTS}$ is meantime applied to an AND gate 73 to disable the gate 73. The AND gate 73 is supplied at its other input with the output of an all −0 detection circuit 74, whose output is "1" initially when the circuit 74 detects the all −0 state of the output of the register 75. Accordingly, the output of the AND gate 73 falls to "0" in response to the interpolation start pulse $\overline{INTS}$ as shown in FIG. 8*b*.

The outputs of the flip-flop 72 and the AND gate 73 are applied to a register 76 and thereby delayed by one bit time according to the clock pulse $\phi$ before being produced from said register 76. As a result, the outputs of the register 76 are as shown in FIGS. 8*c* and 8*d*. The output of the register 76 (FIG. 8*c*) corresponding to the output of the flip-flop 72 is produced as the decreasing mode signal DECM from the control circuit 67 and the output of the register 76 (FIG. 8*d*) corresponding to the AND gate 73 is produced as the stop mode signal STPM. The inverse of the decreasing mode signal DECM obtained through an inverter 77 and the stop mode signal STPM are applied to an OR gate, whose output is produced from the control circuit 67 as the increasing mode signal INCM. Therefore, the increasing mode signal INCM is as shown in FIG. 8.

Of the 2-bit selection control inputs of a selector 79, the $2^0$ bit is provided with the output of the AND gate 73 while the $2^1$ bit with the output of the flip-flop 72. The selector 79 selects the data designating 1, −1, and 0 when the 2-bit code of the selection control input indicates "0", "2" and "3", respectively. The output of the selector 79 is supplied to an adder 80 and thereby added to the data supplied from the register 75. The output of the adder 80 is supplied to the register 75 and delivered from it delayed by one bit time according to the clock pulse $\phi$. The outputs of the selector 79, adder 80 and register 75 are shown in FIGS. 8*e*, 8*f* and 8*g* respectively. Before the interpolation starts, the selector 79 selects the value 0 and the outputs of the adder 80 and register 75 are also 0. Upon generation of the interpolation start pulse $\overline{\text{INTS}}$, the outputs of the flip-flop 72 and the AND gate 73 both are turned to "0", causing the selector 79 to select the value 1. The output of the adder 80 therefore is turned to 1 and, one time slot later, the output of the register 75 is turned to 1. Accordingly, the output of the all −0 detection circuit 74 falls to "0" (see FIG. 8*h*) so that the AND gate 73 produces "0" even after the pulse $\overline{\text{INTS}}$ rises to "1". Therefore, the selector 79 keeps selecting the value "1" and the output of the adder 80 increases as 1, 2, 3, 4 and so on.

The output of the register 75 is supplied to a comparator 81. The comparator 81 also receives data representing M−1 which is smaller than the predetermined maximum interpolation order M by 1 and supplies a signal "1" to a set input S of the flip-flop 72 when the two inputs coincide with each other. When the output of the register 75 has become M−1 (e.g. 4) which is smaller than the predetermined maximum interpolation order M (e.g. 5), a coincidence output signal of the comparator 81 is generated as shown in FIG. 8*a*. This signal sets the flip-flop 72 to cause its output to rise to "1" as shown in FIG. 8*a*. The selector 79 is switched to a state in which numerical value −1 is selected and a numerical value obtained by subtracting 1 from the output M−1=4 of the register 75 is produced by the adder 80. The output of the register 75 thereafter is successively subtracted by 1 until it becomes 0 when the output of the AND gate 73 is turned to "1". The selector 79 thereby is switched to a state in which the numerical value "0" is selected.

The output of the register 75 is supplied to an adder 82 in which the numerical value 1 is added. The output of the adder 82 is delivered out of the control circuit 67 as the delay stage number signal DNUM. As shown in FIG. 8*g*, the output numerical value of the register 75 indicates a number which is smaller than the actual interpolation order by 1. The numerical value 1 therefore is added thereto in the adder 82 whereby the signals DIV and DNUM representing numerical values corresponding to the actual interpolation orders as shown in FIG. 8 are obtained. As will be apparent from the figure, the interpolation order may be so set that it increases sequentially after start of the interpolation up to the predetermined maximum order M (e.g. 5) and thereafter decreases sequentially. As will also be apparent from the figure, there are provided an increase mode signal INCM which is "1" during the period in which the order increases and "0" during the period in which the order decreases, a decrease mode signal DECM which is "0" during the period in which the order increases and "1" during the period in which the order decreases, and a stop mode signal STRAM which is "0" during the interpolation period.

Figure 9:
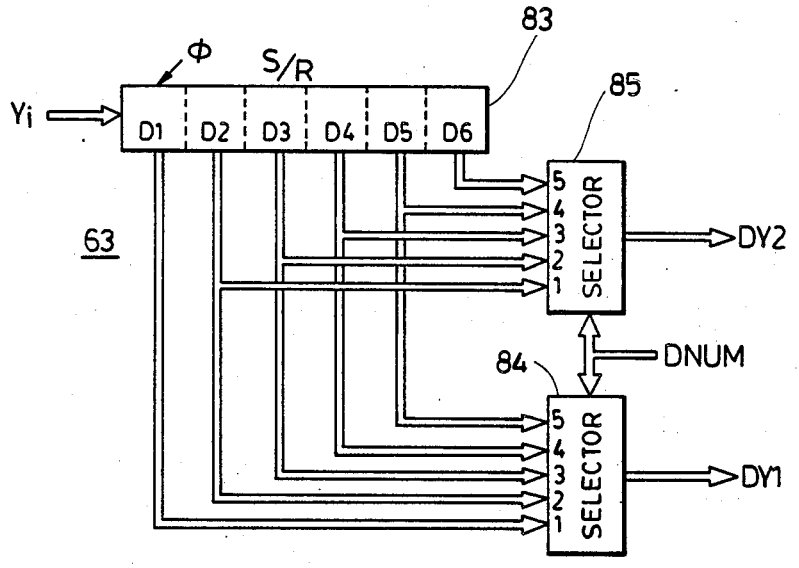
FIG. 9 is a block diagram showing an example of a delay circuit of FIG. 6.

An example of the delay circuit 63 used in the interpolation circuit 59 of FIG. 6 is illustrated in FIG. 9. A shift register 83 to which the amplitude data $Y_i$ read out from the waveshape memory 53 is applied is provided for delaying the data $Y_i$ by one to several bit times. To each of inputs 1 to 5 of a first selector 8 is applied data which is derived by delaying the data $Y_i$ by 1 to 5 bit times. To each of inputs 1 to 5 of a second selector 85 is applied data which is derived by delaying the data $Y_i$ by 2 to 6 bit times. The delay stage number signal DNUM is applied to selector control inputs of the respective selectors 84 and 85 so that one of the inputs 1 to 5 of each selector is selected in response to one of values 1 to 5 of the signal DNUM. If, for example, the signal DNUM is 2 the data $Y_i$ of 2 bit times before is selected through input 2 of the first selector 84 and the data $Y_i$ of 3 bit times before is selected through input 2 of the second selector 85. In this manner, in accordance with the value of the signal DNUM, i.e., the interpolation order for the present sample point, waveshape amplitude value $Y_i$ which precedes the present sample point by the same number of samples as the order and waveshape amplitude value $Y_i$ which precedes the present sample point by the number of samples which is larger than the order by 1 are selected by the selectors 84 and 85 are provided as data DY1 and DY2. Accordingly, in the interpolation order decrease period, amplitude values at the oldest 2 sample points contained in an accumulated amplitude value obtained by the adders 60 and 61 at a sample point immediately before the present sample point can be selected as the data DY1 and DY2. If, for example, the number of the present sample point is 9 and the order is 4, the number of the sample point immediately before is 8 and the order at that sample point is 5, and the accumulated amplitude value is a total of sample point numbers 8, 7, 6, 5 and 4. The oldest 2 sample points among them are 5 and 4 which are the sample point 9−4=5 which precedes the present sample point by the same number of samples 4 as the order 4 at the present sample point and the sample point 9−5=4 which precedes the present sample point by the number of samples 5 which is larger than the order 4 by 1.

Figure 10:
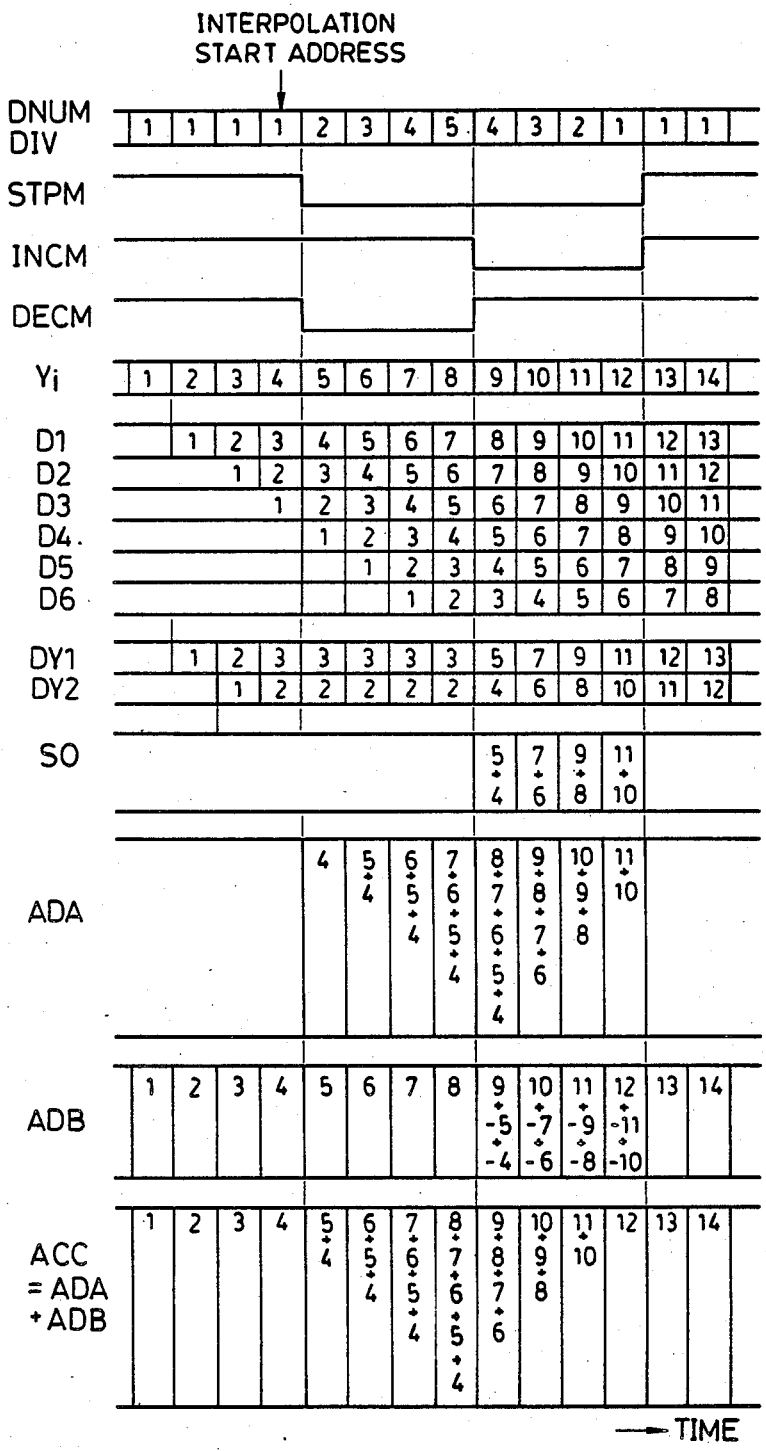
FIG. 10 is a time chart of signals appearing in some portions of an interpolation circuit for describing an example of operation of the interpolation circuit of FIG. 6.

FIG. 10 is a time chart showing an example of operation of the interpolation circuit 59 in which the maximum interpolation order is set at 5. Signals DNUM, DIV, INCM, DECM and STPM produced by the control circuit 67 are the same as those shown in FIG. 8 and other signals are expressed by the sample point number. In the row representing the waveshape amplitude value data $Y_i$ at the present sample point read out from the waveshape memory 53, amplitude values are distinguished by using sample point numbers 1, 2, 3 . . . and contents of the other signals are also expressed by using the sample point numbers. D1 to D6 represent outputs of respective stages of the shift register 83 of FIG. 9. DY1 and DY2 represent outputs of the selectors 84 and 85. SO represents output of the selector 65. ADA represents output of the register 61 applied to the adder 60 through the gate 62. ADB represents output of the subtractor 66. ACC represents output of the adder 60. The positive sign or the negative sign represents addition or subtraction of the waveshape amplitude value $Y_i$ at sample points indicated by the sample point numbers. Since what is meant by FIG. 10 will be clear from the foregoing description, detailed description of FIG. 10 is omitted to avoid duplication. Referring to the row of ACC, it will be understood that the interpolation operation in which the interpolation order gradually increases up to a predetermined value and thereafter gradually decreases is performed.

In FIG. 6, an envelope generator 86 generates, in the same manner as the corresponding one in FIG. 2, an envelope signal of a constant level (maximum number) during readout of the first waveshape and a decay envelope waveshape signal during readout of the second waveshape. An envelope counter 87 and a flip-flop 88 are reset at the start of sounding of the tone by an output pulse of the differentiation circuit 55. The output Q of the reset flip-flop 88 is turned to "0" thereby disabling an AND gate 89 and inhibiting the counting clock pulse $\phi_c$. The envelope counter 87 therefore maintains the "0" state and, in response to the output of this counter 86, an envelope memory 90 continuously produces the envelope data of the maximum level.

In the meanwhile, when the count of the address counter 56 has reached the repeat address, the coincidence detection output EQ of the comparator 91 is turned to "1" and the flip-flop 88 thereby is set. This enables the AND gate 89 to provide the counting clock pulse $\phi_c$ to the envelope counter 87. The count of the counter 87 therefore increases and a decay envelope shape data is read out from the envelope memory 90. This envelope shape data is supplied to the multiplier 70 in which it is multiplied with the waveshape amplitude data produced by the divider 69 of the interpolation circuit 59. Thus, the level of the envelope shape data is constant until the read address of the waveshape memory 53 has first reached the repeat address, i.e., during reading out of the first waveshape, and thereafter, i.e., during reading out of the second waveshape, the level of the envelope shape data gradually decreases. When the contents of the envelope counter 87 have reached a predetermined last address, this state is detected by a last address detection circuit 92 and the flip-flop 88 is reset through an OR gate 93. The supply of the clock pulse $\phi_c$ thereby is stopped, the counter 87 is stopped at the last address and the memory 90 continues to produce data representing the level 0. The output of the multiplier 70 is converted to an analog signal by an analog converter 94 and thereafter is supplied to a sound system 95.

In a case where the construction of FIG. 6 is applied to the automatic rhythm performance apparatus, a rhythm pattern pulse, instead of the output of the start switch 54, may be applied to the differentiation circuit 55. In a case where the construction of FIG. 6 is applied to generation of scale notes, a key-on signal representing depression of a key, instead of the output of the start switch 54, may be applied to the differentiation circuit 55 and the frequency of the clock pulse $\phi$ may be controlled in accordance with the tone pitch of the scale note to be produced. The embodiment of FIG. 6 may be modified as in the embodiment of FIG. 2 so that plural kinds of waveshapes may be produced on a time shared basis.

Figure 11:
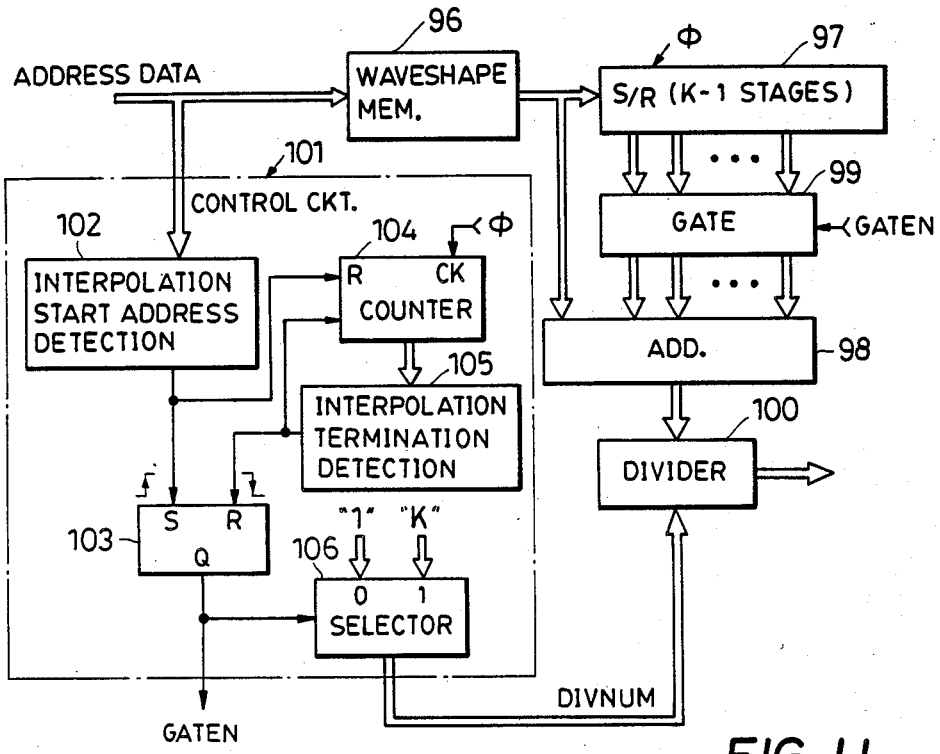
FIG. 11 is an electrical block diagram showing still another embodiment of the invention.

FIG. 11 shows an embodiment capable of performing an interpolation operation which is still different from those shown in FIGS. 2 and 6. In the waveshape memory 96, the first and second waveshapes are stored as in the memories 10 and 53 of FIGS. 2 and 6. In this embodiment, the interpolation operation is performed with a constant interpolation order. In the circuit for generating the read address data of the waveshape memory 96 (not shown), the address increases from the start address to the end address and thereafter repeats increase from the repeat address to the end address in the same manner as in the embodiments of FIGS. 2 and 6.

The waveshape sample amplitude data read out from the waveshape memory 96 is applied to a shift register 97 having the number of stages "K−1" which is smaller than the constant interpolation order K by 1 and also to an adder 98. The shift register 97 produces amplitude data which is delayed by 1 to K−1 bit times in parallel and supplies the data to the adder 98 through a gate 99. The gate 99 is opened by the control signal GATEN only during the interpolation operation. The output of the adder 98 is applied to a divider 100 which produces the constant interpolation order K during the interpolation operation whereas the output of the adder 98 is divided by divisor data DIVNUM representing the numerical value 1 during the period in which the interpolation operation is not performed.

Accordingly, in the section in which interpolation is not performed, the read out output of the waveshape memory 96 only is applied to the adder 98 and this output passes through the divider 100 (its value does not change because it is divided by "1") and is delivered therefrom. On the other hand, in the section in which interpolation is performed, the amplitude data at the present sample point read out from the waveshape memory 96 and the amplitude data up to K−1 sample point before (amplitude data totalling K sample points) are added together in the adder 98 and the result of addition is divided in the divider 100 by the divisor data DIVNUM representing the total sample point K to provide a mean value. In the same manner as in the embodiment of FIG. 2 or 6, an envelope is imparted to the output signal of the divider 100, though illustration thereof is omitted.

The signals GATEN and DIVNUM are generated from a control circuit 101 in response to the waveshape read address data. In the control circuit 101, an interpolation start address detection circuit 102 produces a signal "1" when the read address data has become a predetermined interpolation start address thereby setting a flip-flop 103 and resetting a counter 104. The counter 104 which is provided for performing counting during a predetermined interpolation period from the start of interpolation starts counting of the clock pulse $\phi$ after its release from resetting. An interpolation termination detection circuit 105 which is provided for detecting the fact that the count of the counter 4 has reached a predetermined interpolation termination number produces a signal "1" upon detection of termination of the interpolation thereby stopping the counting operation of the counter 104 and resetting the flip-flop 103. The output of the flip-flop 103 is supplied to the gate 99 as the signal GATEN and also to the control input of a selector 106. The selector 106 selects numerical value 1 when the signal GATEN is "0" and numerical value K when the signal GATEN is "1". The output of the selector 106 is supplied to the divider 100 as the divisor data DIVNUM.

Figure 12:
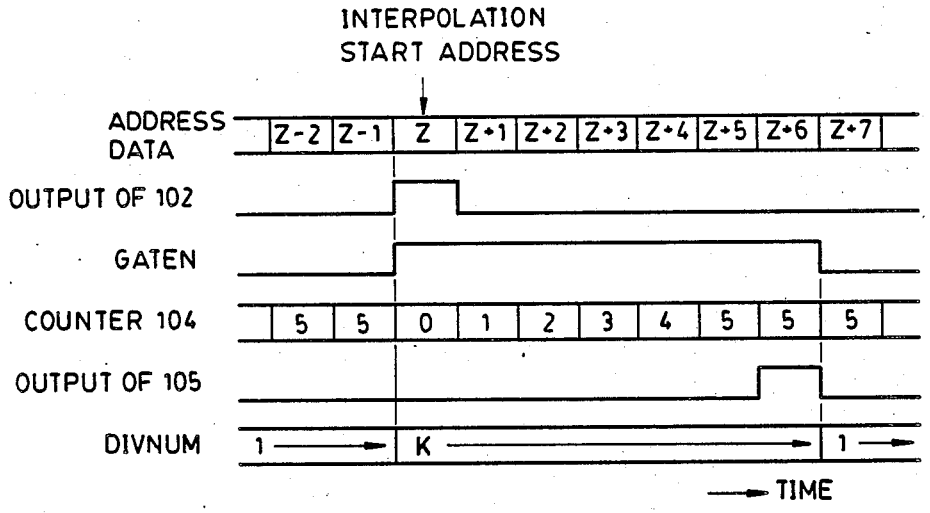
FIG. 12 is a time chart of signals appearing in some portions of FIG. 11 for describing an example of operation of FIG. 11.

An example each of the read address data, output of the interpolation start address detection circuit 102, signal GATEN, contents of the counter 104, output of the interpolation termination detection circuit 105 and contents of the signal DIVNUM is shown in FIG. 12. In this example, the interpolation start address is designated by Z and the interpolation is completed when the count of the counter 104 has become 5.

In the embodiment of FIG. 11, interpolation is terminated when the counter 104 has reached a predetermined value. Alternatively, interpolation may be terminated when coincidence has been detected in comparing the interpolation value with the read out value of the waveshape memory as in the embodiment of FIG. 2.

In embodiments wherein the interpolation order or the maximum interpolation order is constant as those of FIGS. 6 and 11, this interpolation order may be controlled in accordance with the key touch detection signal.

The interpolation operation in the above described embodiments is made when a predetermined interpolation period has arrived. Alternatively, the interpolation operation may always be made and the result of the interpolation operation may be selectively utilized when a predetermined interpolation period has arrived. In the above described embodiments, the address counter for accessing the waveshape memory is an up-counter employing, as the interpolation start address, an address which is smaller than the end address by a predetermined number of addresses. If a down-counter is used as the address counter, an address which is larger than the end address by a predetermined number of addresses must be used as the interpolation start address.

According to this invention, the level and phase of the waveshape amplitude to be stored at the repeat address can be selected as desired with respect to those of the waveshape amplitude to be stored at the end address. If, however, the repeat address is determined in such a manner that the levels and phases of the two waveshape amplitudes approximate each other, the repetitive waveshapes may obviously be further smoothly connected with each other.

In a case where, as previously described, a waveshape for which the interpolation operation has been completed is prestored in the waveshape memory according to the invention, the circuits relating to the interpolation operation shown in FIG. 2, FIG. 6 or FIG. 11 may be omitted and an arrangement may be made such that the second waveshape stored in the waveshape memory for which the interpolation operation has been completed will be repeatedly read out.

As described above, according to the invention, the connection between the respective waveshapes which are repeatedly read out is made smooth by the interpolation operation and, accordingly, strict registering of the amplitude and phase at the beginning and end of the repetitive waveshape is unnecessary whereby selection of a waveshape is facilitated. Further, since the waveshape of the rise portion and the waveshape for repeated reading are separately prepared and a waveshape continuous to the waveshape of the rise portion is used as the waveshape for repeated reading, improvement in the quality of a tone as well as a smooth connection between the rise portion and the repetitive portion can be realized.

What is claimed is:

1. A tone waveshape forming device comprising:

waveshape generation means for generating first waveshape data and thereafter generating second waveshape data repetitively, said first waveshape data representing an attack portion of a tone waveshape corresponding to a tone to be produced and said second waveshape data representing a part of said tone waveshape succeeding said attack portion and including plural periods of said tone;

interpolation section designation means for designating an interpolation section of said succeeding part including a first section near the end of said succeeding part and a second section near the beginning of the section of said succeeding part to be repetitively generated next;

interpolation means for producing new waveshape data by performing an interpolation operation based on said second waveshape data during said interpolation section; and waveshape data outputting means for outputting said first waveshape data and thereafter repetitively outputting said second waveshape data during the section of said succeeding part not designated as an interpolation section, and outputting said new waveshape data during said interpolation section.

2. A tone waveshape forming device as defined in claim 1 wherein said waveshape generation means comprises:

waveshape memory means for storing said first waveshape data and said second waveshape data and read out means for reading out said first waveshape data first and thereafter for repetitively reading out said second waveshape data from said waveshape memory.

3. A tone waveshape forming device as defined in claim 2 wherein said memory means stores said first waveshape data and said second waveshape data in the form of a plurality of sampled values respectively.

4. A tone waveshape forming device as defined in claim 3 wherein said interpolation means comprises:

averaging means for averaging the sampled values of said second waveshape data during said interpolation section and for outputting average sampled values as said new waveshape data.

5. A tone waveshape forming device as defined in claim 4 wherein said interpolation means further comprises:

order setting means for setting an interpolation order which is an order of said interpolation operation.

6. A tone waveshape forming device as defined in claim 5 wherein said averaging means comprises:

accumulating means for sequentially accumulating said sampled values of said second waveshape data during said interpolation section at every generation of said sampled values and dividing means for dividing the accumulated value obtained by said accumulating means by the interpolation order set by said order setting means at every generation of said sampled values and for outputting the divided accumulated values as said averaged sampled values.

7. A tone waveshape forming device as defined in claim 5 wherein said interpolation order increases at every generation of said sampled values of said second waveshape data during said interpolation section and wherein said interpolation section designating means comprises detection means for detecting the fact that the averaged sampled value has substantially become equal to a specific one of said sample values of said second waveshape data, the end of said interpolation section being determined by said fact of said detection.

8. A tone waveshape forming device as defined in claim 5 wherein said interpolation order sequentially increases during said first narrow section at every generation of said sampled values and decreases during said second narrow section at every generation of said sampled values.

9. A tone waveshape forming device as defined in claim 5 wherein said interpolation order is constant.

10. A tone waveshape forming device as defined in claim 1 wherein said waveshape data outputting means comprises:

selection signal generating means for generating a selection signal indicating the period corresponding to said interpolation section; and selector means for repetitively selecting said second waveshape data during the other section than said interpolation section and said new waveshape data during said interpolation section in accordance with said selection signal after selecting said first waveshape once.

11. A tone waveshape forming device comprising a waveshape memory storing a first waveshape consisting of waveshapes of plural periods for a rise portion of a tone and a second waveshape continuous to the first waveshape and consisting of waveshapes of plural periods from which waveshape memory said first waveshape is read out once and thereafter said second waveshape is repeatedly read out, said second waveshape being produced by the following steps (a), (b) and (c):

(a) taking a third waveshape consisting of waveshapes of plural periods including a rise portion and a fourth waveshape consisting of waveshapes of plural periods continuous to this third waveshape out of a desired original tone waveshape;

(b) performing a predetermined interpolation operation for a section from a specified section at the end of said taken out fourth waveshape to a specified section at the beginning of said fourth section by employing waveshape sample amplitude data for said section; and (c) connecting a waveshape portion consisting of the waveshape sample amplitude data obtained by said interpolation operation to the end of a waveshape obtained by removing said end and beginning specified sections from said fourth waveshape and storing the resulting waveshape as said second waveshape in said waveshape memory, and said first waveshape being obtained by connecting the waveshape of the specified section at the beginning of said fourth waveshape to the end of said third waveshape.

12. A tone waveshape forming device as defined in claim 11 wherein said interpolation operation of the step (b) is an operation which computes a mean value of two or more adjacent waveshape sample amplitude data with respect to each sample point.

13. A tone waveshape forming device as defined in claim 11 wherein said interpolation operation utilizes interpolation means comprising:

averaging means for averaging the sampled values of said specified section of said fourth waveshape and for outputting average sampled values.

14. A tone waveshape forming device as defined in claim 13 wherein said interpolation means further comprises:

order setting means for setting an interpolation order which is an order of said interpolation operation.

15. A tone waveshape forming device as defined in claim 14 wherein said averaging means comprises:

accumulating means for sequentially accumulating said sampled values of said fourth waveshape at every generation of said sampled values and dividing means for dividing the accumulated value obtained by said accumulating means by the interpolation order set by said order setting means at every generation of said sampled values and for outputting the divided accumulated values as said averaged sampled values.

16. A tone waveshape forming device as defined in claim 14 wherein said interpolation order increases at every generation of said sampled values of said fourth waveshape data and wherein said interpolation means further comprises detection means for detecting the fact that the averaged sampled value has substantially become equal to a specific one of said sample values of said fourth waveshape data, the end of said specified section being determined by said fact of said detection.

17. A tone waveshape forming device as defined in claim 14 wherein said interpolation order sequentially increases during said specified end section of said fourth waveshape at every generation of said sampled values and decreases during said specified beginning section of said fourth waveshape at every generation of said sampled values.

18. A tone waveshape forming device as defind in claim 14 wherein said interpolation order is constant.

* * * * *